US006898552B2

(12) United States Patent
Marcichow

(10) Patent No.: US 6,898,552 B2
(45) Date of Patent: May 24, 2005

(54) PROGRAMMED WATER FLOW THROUGH ELECTRONIC PLUMBING DEVICES AND RELATED METHODS

(75) Inventor: Martin E. Marcichow, Hoffman Estates, IL (US)

(73) Assignee: Sloan Valve Company, Franklin Park, IL (US)

( * ) Notice: Subject to any disclaimer, the term of this patent is extended or adjusted under 35 U.S.C. 154(b) by 79 days.

(21) Appl. No.: 10/459,276

(22) Filed: Jun. 11, 2003

(65) Prior Publication Data

US 2004/0254746 A1 Dec. 16, 2004

(51) Int. Cl.[7] ..... F16K 17/00

(52) U.S. Cl. ..... 702/182; 702/89; 702/100; 702/176; 137/486

(58) Field of Search ..... 702/89, 100, 176, 702/182; 251/129.04; 340/606; 236/938, 12.12, 12.16; 137/360, 460, 486, 487, 487.5, 495, 624.11, 624.12, 613, 563, 883, 552, 625.4; 73/3, 592; 4/313, 304, 378, 379, 380, 387, 389, 390, 623, 663

(56) References Cited

U.S. PATENT DOCUMENTS 4,705,060 A * 11/1987 Goulbourne ..... 137/102
4,911,200 A * 3/1990 Ben-Arie ..... 137/486
4,926,901 A * 5/1990 Waltenburg ..... 137/456
5,086,806 A * 2/1992 Engler et al. ..... 137/486
5,170,514 A * 12/1992 Weigert ..... 4/313
5,655,749 A * 8/1997 Mauerhofer ..... 251/129.04
5,829,475 A * 11/1998 Acker ..... 137/337
6,273,394 B1 * 8/2001 Vincent et al. ..... 251/129.04
6,481,634 B1 * 11/2002 Zosimadis ..... 236/12.12
6,523,562 B2 * 2/2003 Harper ..... 137/312
6,691,338 B2 * 2/2004 Zieger ..... 4/605
2003/0192600 A1 * 10/2003 Ford ..... 137/624.12
2004/0070091 A1 * 4/2004 Rotering et al. ..... 261/70

* cited by examiner

*Primary Examiner*—Carol S. W. Tsai
(74) *Attorney, Agent, or Firm*—Cook, Alex, McFarron, Manzo, Cummings & Mehler, Ltd.

(57) ABSTRACT

An electronic plumbing device, such as a faucet, has a microprocessor that is programmed to periodically purge stagnant water remaining in the faucet at predetermined time intervals. The microprocessor energizes a solenoid associated with a water valve to initiate the flow of water through the faucet in response to a detector sensing the presence of a user near the faucet. A first timer is programmed into the microprocessor and controls the minimum run time of the faucet for activations initiated by either a user or by the purge feature. A second timer is also programmed into the microprocessor to measure a second predetermined time interval. If the faucet is not used during the second predetermined time interval, the microprocessor will energize the solenoid for the minimum run time to open the water valve and flush out any stagnant water remaining in the faucet from the prior activation.

19 Claims, 4 Drawing Sheets

| SWITCH SET | | | | |
|---|---|---|---|---|
| SW.#1 | SW. #2 | SW. #3 | ON TIME | SW. # 4 |
| OFF | OFF | OFF | 3 MINS. | "OFF" FOR EXTENDED RANGE |
| ON | OFF | OFF | 30 SECS. | |
| OFF | ON | OFF | 20 MINS. | |
| ON | ON | OFF | 8 SECS. | |
| OFF | OFF | ON | 12 SECS. | "ON" FOR SHORTED RANGE |
| ON | OFF | ON | 12 SECS. | |
| OFF | ON | ON | 60 SECS. | |
| ON | ON | ON | 45 SECS. | |

PROGRAMMED WATER FLOW THROUGH ELECTRONIC PLUMBING DEVICES AND RELATED METHODS

FIELD OF THE INVENTION

The present invention relates to the field of electronic plumbing devices, and more specifically to electronic plumbing devices with a programmed and periodically activated self-cleaning function with a minimum activation time that reduces bacterial count. In addition, there is a minimum time required for the faucet to flow water for each activation.

BACKGROUND OF THE INVENTION

Many electronic plumbing devices, such as faucets, have two basic modes of operation; the on-demand mode and the metered mode. In the on-demand mode, the electronics in the faucet sense the presence of a target in proximity to the faucet outlet, such as when a person's hands are placed under the faucet, and initiate the flow of water. Typically, the electronic faucet permits the flow of water for a preset time and then terminates the flow either at this preset time or when the user's hands are removed from under the faucet. In the metered mode, the faucet is turned on for a set time duration irrespective of how long the user's hands are under the faucet. However, neither of these modes is designed to periodically activate the faucet for a minimum flow or run time during normal use to flush out the water in the faucet to reduce or eliminate bacterial accumulation in the faucet, especially during infrequent use of the faucet. In addition, the time that the unit is activated in either of the common modes does not depend upon the minimum run time required to reduce bacteria.

Electronic faucets are in widespread use. Such faucets are preferred in many applications because of their water saving capabilities. Electronic faucets are also preferred in many health institutions and in public buildings because there is less likelihood of transfer of bacteria. This is because the users do not typically need to come in physical contact with faucet handles to activate the flow of water since electronic faucets are self-activating. In contrast, the handle or handles of a mechanical faucet are usually contacted by multiple users and can be a source of bacterial transfer between users.

However, electronic faucets typically have a larger volume or column of water between the outlet and the shut-off valve than mechanical faucets. This volume of water can become stagnant in infrequently used electronic faucets, or can become exposed to the air or to other sources of contamination, such as bacteria. For example, some sources have reported higher bacterial counts in the water column of some electronic faucets, as compared to mechanical faucets. Health institutions, such as hospitals, are especially sensitive to bacteria in faucets because it can potentially lead to more serious consequences. Because users of mechanical faucets tend to leave them running, especially during hand washing, mechanical faucets frequently have less bacteria in the water remaining in the faucet than electronic faucets.

There is therefore a need for an improved electronic faucet that is capable of reducing the amount of bacteria in the water remaining in the faucet. There is also a need to provide a minimum amount of water flow each time that the electronic faucet is activated. There is a further need to flush the water column with each activation. There is also a need to periodically activate an electronic faucet during extended periods of nonuse to discharge and to refresh the water retained in the water column of the faucet between the outlet and the shutoff valve.

Accordingly, it is a general object of the present invention to provide a new and improved electronic faucet with a periodically activated water flow with a means of providing a minimum amount of water and a minimum time that the faucet is activated to discharge any stagnant water remaining in the faucet, thereby reducing bacterial count in the faucet.

Another object of the present invention is to have a minimum amount of water flushed from the plumbing device with each activation.

Another object of the present invention is to provide a timer for timing the time in which the faucet is dormant so that the faucet may be periodically activated, such as after about 15 minutes to about 12 hours, and preferably about every four hours.

A further object of the present invention is to provide a minimum amount of time that the faucet remains on during the periodic activation, such as about 8 seconds.

SUMMARY OF THE INVENTION

The present invention is directed to an electronic plumbing device, such as a faucet, and to electronic circuits that are programmed to periodically purge water remaining in the faucet from a prior activation and a means of providing a minimum amount of water and a minimum amount of time that the faucet is activated to reduce bacterial count and/or bacterial build-up. The present invention is also directed to related methods of periodically purging the water from the faucet for similar reasons.

A water valve in the faucet operates between open and closed positions, with the water valve normally in the closed position to block the flow of water. The water valve includes a solenoid to open the valve and to permit the flow of water through the faucet when the solenoid is energized. Electronic circuitry includes a detector, which may be of the infrared type, to detect the presence of a user near the faucet and to develop a detector signal. A microprocessor is in communication with the detector and with the solenoid to cause the solenoid to be energized when the detector signal is present.

A first timer in the microprocessor times a first predetermined interval that is representative of a minimum run time for the electronic plumbing device. In the on-demand mode, the microprocessor terminates energization of the solenoid after the longer of the minimum run time or when the detector signal ceases. For example, this first predetermined time interval for the minimum run time may be about 8 seconds. In the metered mode, the activation time is always longer than the minimum run time.

A second timer in the microprocessor times a second predetermined interval beginning when energization of the solenoid terminates. The microprocessor energizes the solenoid at the end of the second predetermined interval to open the water valve for the minimum run time and to flush any stagnant and/or contaminated water out of the faucet. Any activation of the faucet by a user during the second predetermined time interval will automatically reset or restart the timing of the second predetermined interval. This second predetermined time interval may be in the range of about 4 hours.

A third timer in the microprocessor may be used to time the time that the plumbing device is on. This timer can limit the maximum time that the device is on and thus conserve water. This timer is known as the time-out timer. Thus, in the on-demand mode, the water is on for some duration between the minimum run time (the time required to purge the water column) and the time-out setting of the device, which limits water usage.

Yet another timer that may be used in the microprocessor is the off-delay timer. This timer allows the user to exit and reenter the detection zone of the device without interrupting water flow. This time is typically approximately one second.

The present invention is also directed to related methods of periodically flushing any stagnant or bacterially contaminated water from the electronic plumbing device, and guaranteeing that the device is flushed with each activation. Such methods include developing a detector signal in response to the presence of a user, energizing the solenoid in response to the detector signal, initiating a first timer to time a first predetermined time interval representative of a minimum run time when the solenoid is energized, terminating energization of the solenoid at the longer of the first predetermined time interval, when the detector signal ceases or when the time-out has been reached, initiating a second timer to time a second predetermined time interval when energization of the solenoid terminates, and energizing the solenoid at the end of the second predetermined time interval for a minimum run time to flush any water remaining in the faucet from the prior activation of the faucet. Preferably, the second timer is reset each time that energization of the solenoid is terminated.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawing figures, in which like reference numerals identify like elements, and in which:

DETAILED DESCRIPTION OF THE INVENTION

Figures 1, 3:
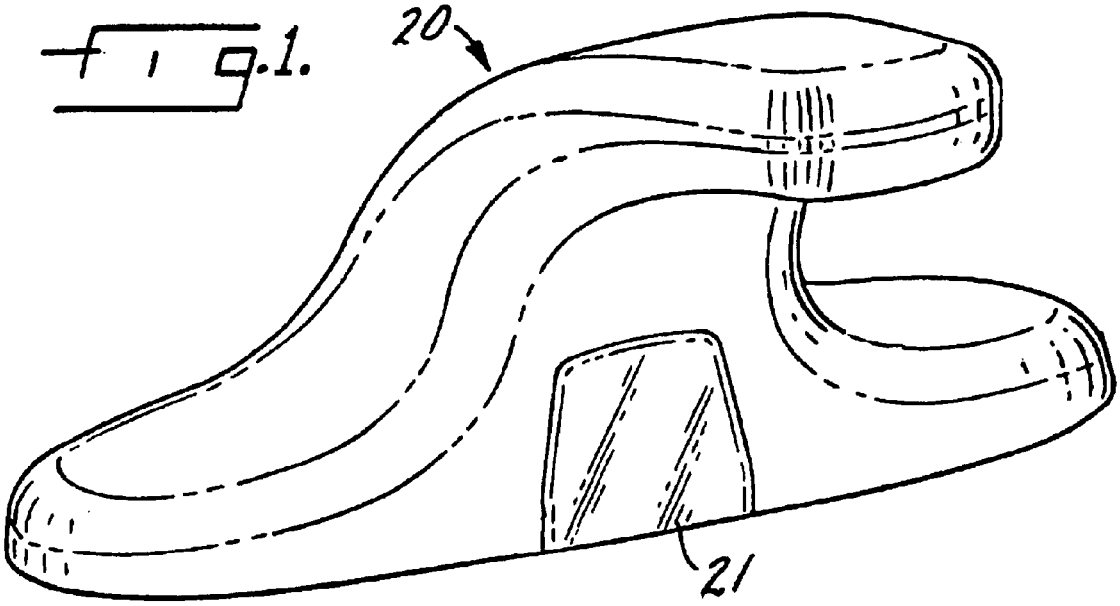
FIG. 1 is a front perspective view of an electronic faucet which may practice the present invention.
FIG. 3 is a table illustrating different exemplary on times for the faucet of FIG. 1 depending upon the settings of a switch in the electronic circuitry shown in FIG. 2.

Referring to the Figures, and particularly to FIG. 1, an electronic faucet, generally designated 20, is constructed in accordance with the invention. Faucet 20, as illustrated in FIG. 1, is also shown in U.S. Design Pat. No. Des. 424,169 issued on May 2, 2000, which is assigned to Sloan Valve Company, the same assignee of the present invention. It will be understood that faucet 20 may be any of many different styles or types other than that shown in FIG. 1. As is customary with electronic faucets, faucet 20 is devoid of any operative handles for turning the water flow on or off, and relies instead upon an electronic sensor to detect the presence of a person's hands near the faucet to initiate the flow of water through the faucet.

The present invention may also be utilized in other types of electronically actuated plumbing devices, including electronic showers and electronically actuated shower heads. Thus, while the expression "electronic faucet" or "faucet" is used herein, it will be understood to encompass other electronically actuated plumbing devices in which it may be similarly desirable to periodically flush stagnant water from the device, especially during periods of infrequent use of the plumbing device.

Electronic faucet 20 may have window or lens 21 disposed near a base of faucet 20, such as to sense the presence of a person's hands in proximity to the faucet. An electronic sensor is typically disposed behind lens 21, in a manner known to the art. For example, U.S. Pat. Nos. 6,294,786 and 6,161,814, which are assigned to the same assignee as the present invention, teach forms of sensors that include an infrared transmitter and an infrared receiver. U.S. Pat. Nos. 6,294,786 and 6,161,814 are incorporated by reference herein in their entireties.

Figure 2:
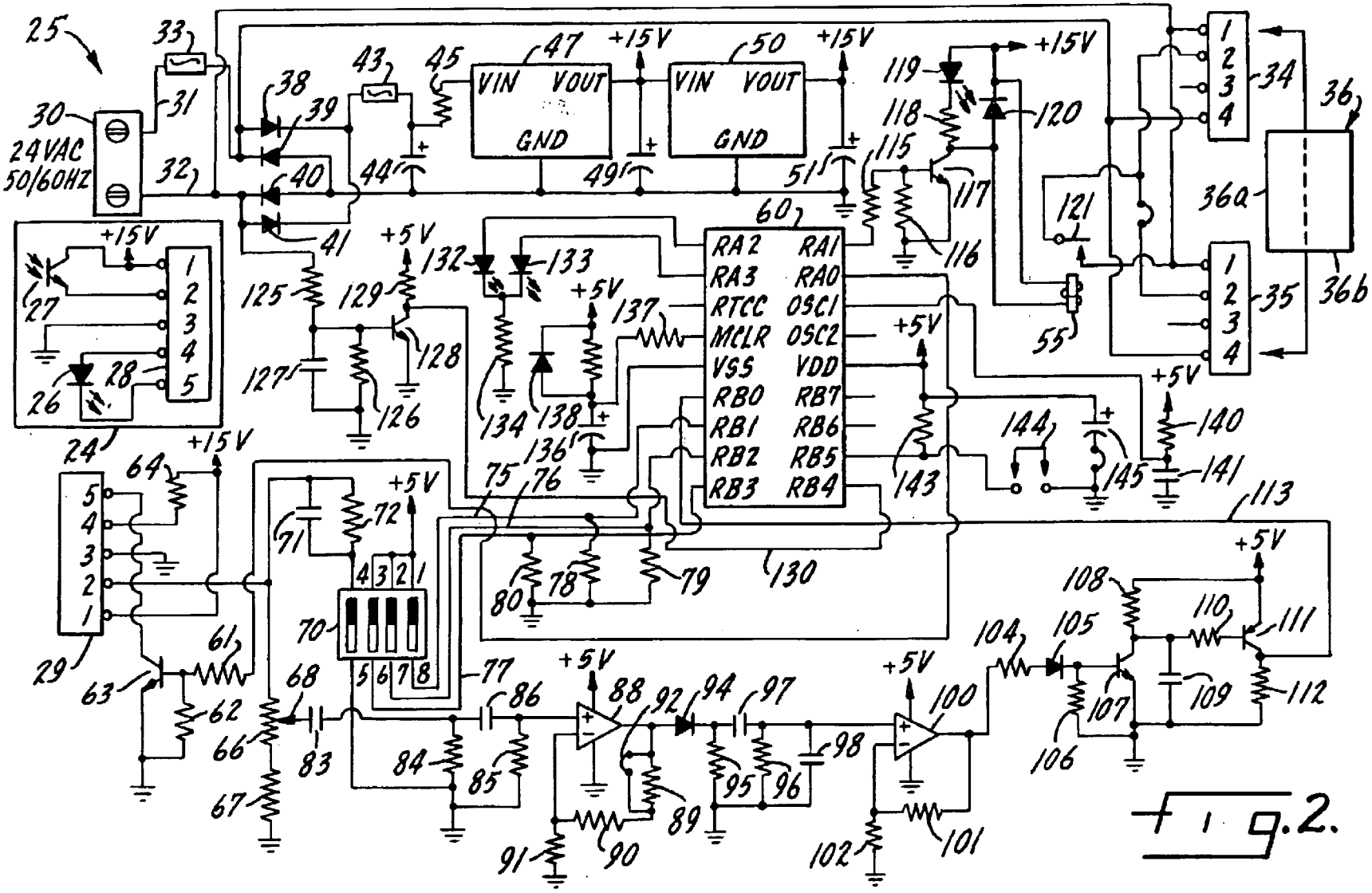
FIG. 2 is a schematic diagram of electronic circuitry that may be incorporated into the faucet illustrated in FIG. 1 in accordance with the present invention.

The preferred embodiment for the electronic circuitry for faucet 20 is shown in FIG. 2 and is generally designated by reference numeral 25. In this embodiment, the electronic sensor is included within a box 24, also identified as a sensor assembly, and includes an infrared emitting diode 26 and an infrared detecting photo-transistor 27. Infrared emitting diode 26 and transistor 27 may be connected via a connector 28 to a mating connector 29 to the remainder of the electronic circuitry 25.

Circuitry 25 may typically obtain its power from a 24 VAC power source, either 50 or 60 Hz, such as at a terminal block 30. A thermal fuse 33 is in series with a line 31 from terminal block 30. The 24 VAC lines 31 and 32 are routed to a pair of connectors 34 and 35, which in turn are connected to a water flow control valve 36. Water control valve 36 may include two solenoid valves 36*a* and 36*b*, as seen in FIG. 2. Power input lines 31 and 32 are also connected to a full-wave diode rectification bridge, consisting of diodes 38–41 to rectify the AC voltage. Another thermal fuse 43 is connected to the diode bridge, and a capacitor 44 helps filter the DC voltage. An integrated circuit (IC) voltage regulator 47 has an input terminal VIN connected via a resistor 45 to filtering capacitor 44. Voltage regulator 47 provides a regulated 15 VDC at its output terminal VOUT, which is also connected to another filtering capacitor 49. Another IC voltage regulator 50 has its input terminal VIN connected to the 15 VDC supplied by the output of voltage regulator 47 to supply a regulated 5VDC at its output terminal VOUT. A filter capacitor 51 assists in filtering this 5 VDC supply voltage. Most of electronic circuitry 25 operates from the 5 VDC supplied by voltage regulator 50. However, infrared emitting diode 26 and detector photo-transistor 27 are biased from the 15 VDC supplied by voltage regulator 47, as is that portion of the circuitry associated with a relay 55 that controls the water flow valve 36, which may include two valves 36*a* and 36*b*.

A microcontroller or microprocessor 60 monitors and controls the operation of the electronic circuitry. For example, microprocessor 60 may be part number PIC16C54 commercially available from Microchip Technology, Inc. of Chandler, Ariz. In this example of FIG. 2, a logic high signal at output pin RA0 of microprocessor 60 will cause resistors 61 and 62 to bias transistor 63 into a conductive state, which will sink current from the 15 VDC voltage supply through resistor 64, through terminals 4 of connectors 28 and 29, through infrared emitting diode 26, through terminals 5 of connectors 28 and 29 and through transistor 63 to ground. Thus, microprocessor output RA0 permits diode 26 to emit infrared radiation only when output RA0 is in a logic high state.

When diode 26 is emitting infrared radiation, detecting transistor 27 may be receiving reflected radiation when a user's hands are disposed in proximity to the sensor assembly 24, which will render transistor 27 conductive to supply current from the 15 VDC voltage supply through terminals 2 of connectors 28 and 29, through adjustable resistor or potentiometer 66 and through resistor 67 to ground. The wiper arm 68 of potentiometer 66 may be adjusted to select the desired sensitivity of sensor portion of electronic circuitry 25. A portion of the signal supplied by detector transistor 27 may be attenuated by a resistor 72 and a capacitor 71, which are connected to ground when contacts 4 and 5 of a multiple contact switch 70 are closed.

Switch 70, in the illustrated embodiment, has four separate switches, with switch #1 including contacts numbered 1 and 8 in FIG. 2, switch #2 including contacts 2 and 7, switch #3 including contacts 3 and 6 and switch #4 including contacts 4 and 5. Switch #1 is connected between the 5 VDC voltage supply and line 75 to input pin RB1 of microprocessor 60. Switches #2 and #3 are similarly connected between the 5 VDC voltage supply and lines 76 and 77 to input terminals RB2 and RB3 of microprocessor 60, respectively. Lines 75–77 are referenced to ground by resistors 78–80, respectively. The settings of switches #1 through #3 enable the user to select the length of time that water flow valve 36 will remain in the on condition to permit water to flow through faucet 20 after a user is first sensed. That is, microprocessor 60 will interpret the settings of switches #1 through #3 at its input terminals RB1–RB3 to determine the amount of time that water flow valve 36 should remain in the on condition. For example, one set of times for water flow valve 36 to remain on for each of the possible settings of switches #1 through #3 is shown in the table of FIG. 3. In this example, faucet 20 will continue to supply water after the detection of a user by detector transistor 27 in selectable range of steps from about 8 seconds to about 20 minutes. In order to best flush most bacterial contamination from the water remaining in faucet 20, water flow valve 36 is preferably activated for about 8 to 12 seconds, or longer.

Signals received from detector transistor 27 at wiper arm 68 of potentiometer 66 are coupled by a capacitor 83 to an RC network, consisting of resistors 84 and 85 and capacitor 86, to the non-inverting input of an operational amplifier 88. In a known manner, the gain of operational amplifier 88 is determined by resistors 89, 90 and 91, which are connected between the output and the inverting input of amplifier 88. The gain of amplifier 88 may be varied by means of a jumper 92 that provides a short across resistor 89. The inverting input of amplifier 88 is also referenced to ground through resistor 91.

The amplified signals at the output of amplifier 88 are provided to a diode 94 and to another RC network, consisting of resistors 95 and 96 and capacitors 97 and 98, to the non-inverting input of another operational amplifier 100. It will be appreciated that diode 94 will only pass positive-going pulses that are greater than the present potential across the RC network at the non-inverting input of amplifier 100. A feedback resistor 101 is connected between the output and inverting inputs of amplifier 100 and a resistor 102 references the inverting input to ground. Amplifier 100 thus amplifies the positive pulses presented at its non-inverting input and supplies these amplified pulses at its output through a resistor 104 and a diode 105 to the base of an NPN transistor 107. A positive pulse at the base of transistor 107 will cause transistor 107 to become conductive, thereby drawing base current from a PNP transistor 111 through resistor 110. A capacitor 109 provides noise filtering. When transistor 107 draws base current from transistor 111, transistor 111 also becomes conductive. Transistor 111 then establishes a logic high level across a collector resistor 112, which is presented via a line 113 to the RB0 input to microprocessor 60. Thus, that portion of electronic circuitry 25 associated with amplifiers 88 and 100 and transistors 107 and 111 amplifies and conditions the signals from detector transistor 27 into a form that is compatible with an input terminal of microprocessor 60. As long as detector transistor 27 receives reflected infrared signals from infrared emitter diode 26 due to the presence of a target in proximity to the infrared sensor, corresponding signals will be presented to input RB0 of microprocessor 60.

When microprocessor 60 first senses a pulse at input RB0, it will cause water flow valve 36 to be actuated to the on condition. This is accomplished by changing output RA1 to a logic high level, which causes a pair of resistors 115 and 116 to positively bias the base terminal of an NPN transistor 117. Transistor 117 is then rendered conductive which energizes a relay 55, thereby causing the normally open contacts 121 of relay 55 to close. Closure of contacts 121 applies 24 VAC to water flow valve 36 (which may consist of two valves 36*a* and 36*b*) to hold valve 36 in the on condition, which permits water to flow through the associated faucet 20. Also connected in the collector circuit of transistor 117 is a resistor 118 in series with a light emitting diode (LED) 119. When transistor 117 becomes conductive, light-emitting diode will indicate that the water flow valve is in the on condition. A diode 120 provides an inductive current path for the inductive coil of relay 55 when transistor 117 returns to its normally nonconductive state.

Another portion of electronic circuitry 25 senses the line voltage on line 32 of the 24 VAC power supply to provide a 60 Hz reference signal to microprocessor 60. This 60 Hz reference signal may be used by microprocessor 60 to time the time durations that faucet 20 is on, such as the selectable times shown in the table of FIG. 3. A pair of resistors 125 and 126 provides a portion of the 24 VAC signal to the base of NPN transistor 128. A capacitor 127, in parallel with resistor 126, provides noise filtering. Thus, transistor 128 will be conductive during positive half cycles of the 24 VAC, which will pull down the potential at the collector of transistor to a logic low level. This logic low level is presented via a line 130 to microprocessor input terminal RB4.

Microprocessor output pin RA2 is connected to an LED 132. Similarly, output terminal RA3 is connected to another LED 133. LEDs 132 and 133 share a common resistor 134 to ground. For example, LED 132 may be a green LED that is illuminated when input power is available to faucet 20 and to electronic circuitry 25. LED 133 may be a red LED that is illuminated when detector transistor 27 has detected the presence of a person. Microprocessor 60 may permit only one of LEDs 132 or 133 to be illuminated at any time. Thus, when LED 133 is illuminated due to detection of a person in proximity to the faucet 20, LED 132 may be extinguished until relay 55 terminates the flow of water through water valve 36, including the two valves 36*a* and 36*b*. At that time, LED 132 is again illuminated to indicate that input power is available and that faucet 20 is operative.

A power on reset circuit at microprocessor input terminal MCLR initializes microprocessor when power is first applied. A capacitor 136 slowly charges up to initially hold terminal MCLR at a low logic level. If power is turned off or lost, a diode 138 provides a rapid discharge path for capacitor 136 to reset this circuit for the next power on.

A resistor 140 and a capacitor 141 are connected to microprocessor terminal OSC1 to provide an internal oscillator and clock function for microprocessor 60. Microprocessor 60 receives operating power at terminal VDD from the 5 VDC power supply 50. A capacitor 145 provides additional filtering of the 5 VDC power source at the microprocessor terminal VDD. A pull-up resistor 143 normally biases terminal RB5 at a logic high level. However, if a jumper 144 is connected between terminal RB5 and ground, terminal RB5 will be at a logic low level. Jumper 144 determines whether electronic circuitry 25 controls water flow valve 36, and hence, faucet 20, in the metered mode or the non-metered mode.

Figure 4:
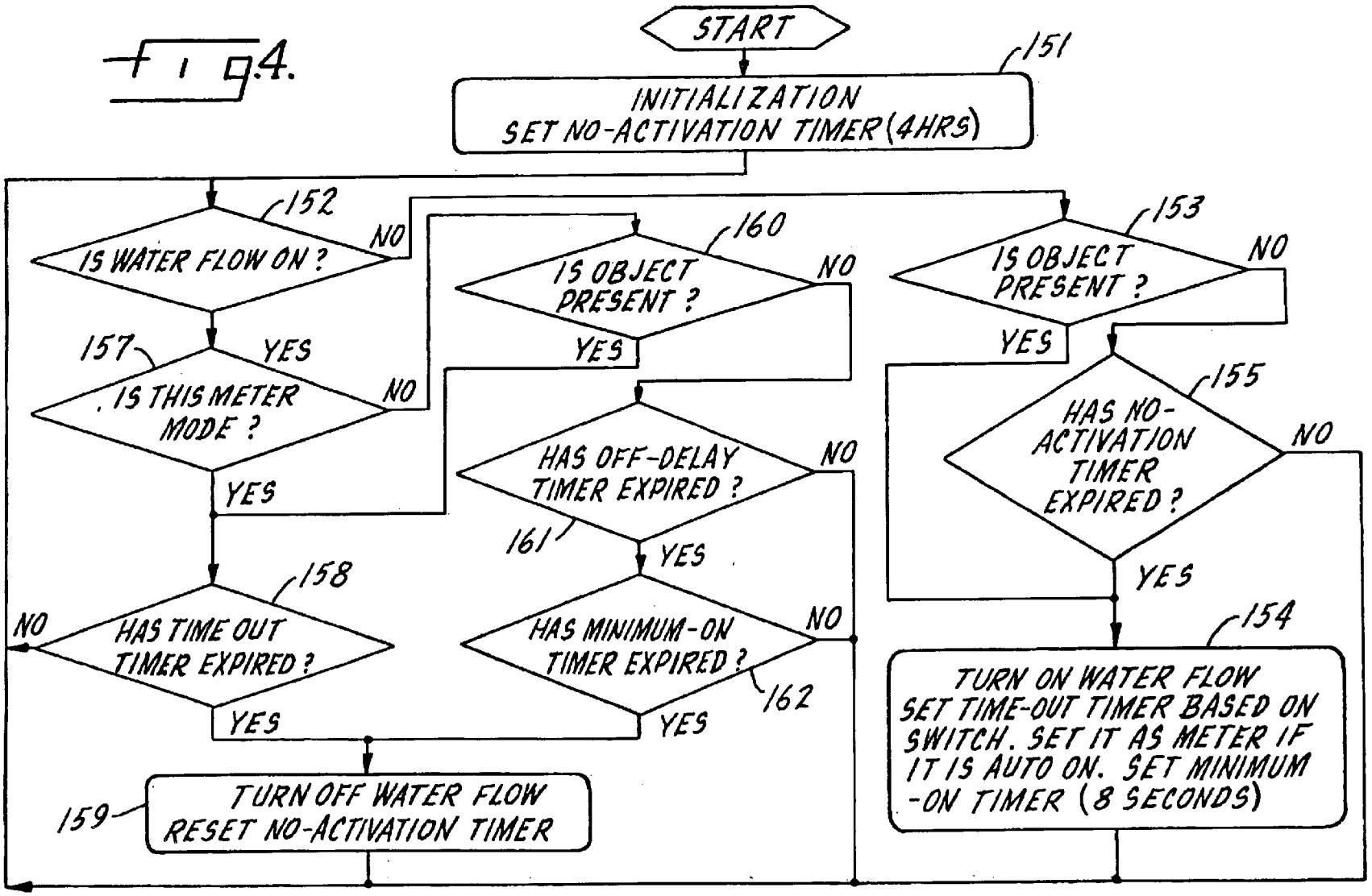
FIG. 4 is a flow chart illustrating the steps preformed by the electronic circuitry shown in FIG. 2, also in accordance with the present invention.

FIG. 4 contains a flowchart of the steps performed by microprocessor 60 in controlling the flow of water through faucet 20. Upon application of power to the electronic faucet 20, microprocessor 60 is initialized, clocks may be set to zero and a no-activation timer is set to a preselected time, such as about 4 hours, as indicated at block 151. Whether water flow is already on is determined at block 152. If not, block 153 determines if an object is present at the faucet. As previously explained, this step may be accomplished by monitoring microprocessor input terminal RB0 to see if any signal is received from detector transistor 27 in FIG. 2. If an object is detected, the water flow is turned on at block 154 by energizing and opening the water flow valve 36. Block 154 also initiates a time-out timer to control the duration of the flow of water, with the duration preselected by the settings of switch 70 and as further shown in the table of FIG. 3. A minimum run time clock may also be set to eight seconds.

In accordance with one aspect of the present invention, if the water is not flowing at block 152 and if no object is detected at block 153, block 155 will determine if the no-activation timer has expired. If not, the routine returns through blocks 152 and 153 until the no-activation timer has expired or until an object has been detected. Upon expiration of the time-out timer, block 154 causes water flow valve to be energized and opened to initiate the flow of water for a minimum run time. For example, this minimum run time may be programmed into the microprocessor, and is preferably a minimum of about 8 seconds to ensure that the stagnant water in the faucet is fully discharged. However, if faucet 20 is in the metered mode, a set run time, for example, about 8 seconds, is activated. Block 154 thereby causes faucet 20 to initiate the flow of water after a predetermined interval of inactivity, which in this instance is selected to be about 4 hours, to periodically flush the water remaining in faucet 20 to reduce any bacterial contamination that may have accumulated in the water remaining in the faucet from the prior activation.

Once water flow is initiated by sensing the presence of an object at the faucet 20, block 157 will determine if faucet 20 is in the metered mode. If so, block 158 will determine whether the time-out timer associated with the metered mode has expired. If not, the routine continues to block 152. However, if the time-out timer for the metered mode has expired, block 159 terminates the flow of water and also resets the no-activation timer.

If it is determined at block 157 that faucet 20 is not in the metered mode, block 160 determines if an object is still present at the faucet. If so, block 158 tests to see if the time-out timer has expired. However, if block 160 determines that an object is no longer present, block 161 determines if an off-delay timer has expired. For example, an off-delay timer to delay terminating the flow of water may be desirable to provide the user with sufficient time to reach for soap, disinfectant, or the like, without interrupting or terminating the flow of water. If the off-delay timer has not expired, the process returns to block 152. However, if the off-delay timer has expired, block 162 determines if the minimum on timer has expired. If so, block 159 terminates the flow of water and also resets the no-activation timer. If the minimum on timer has not expired in block 162, the process returns to block 152. This insures that the water is on for the minimum run time and that the water column is purged to reduce bacteria.

Figure 5:
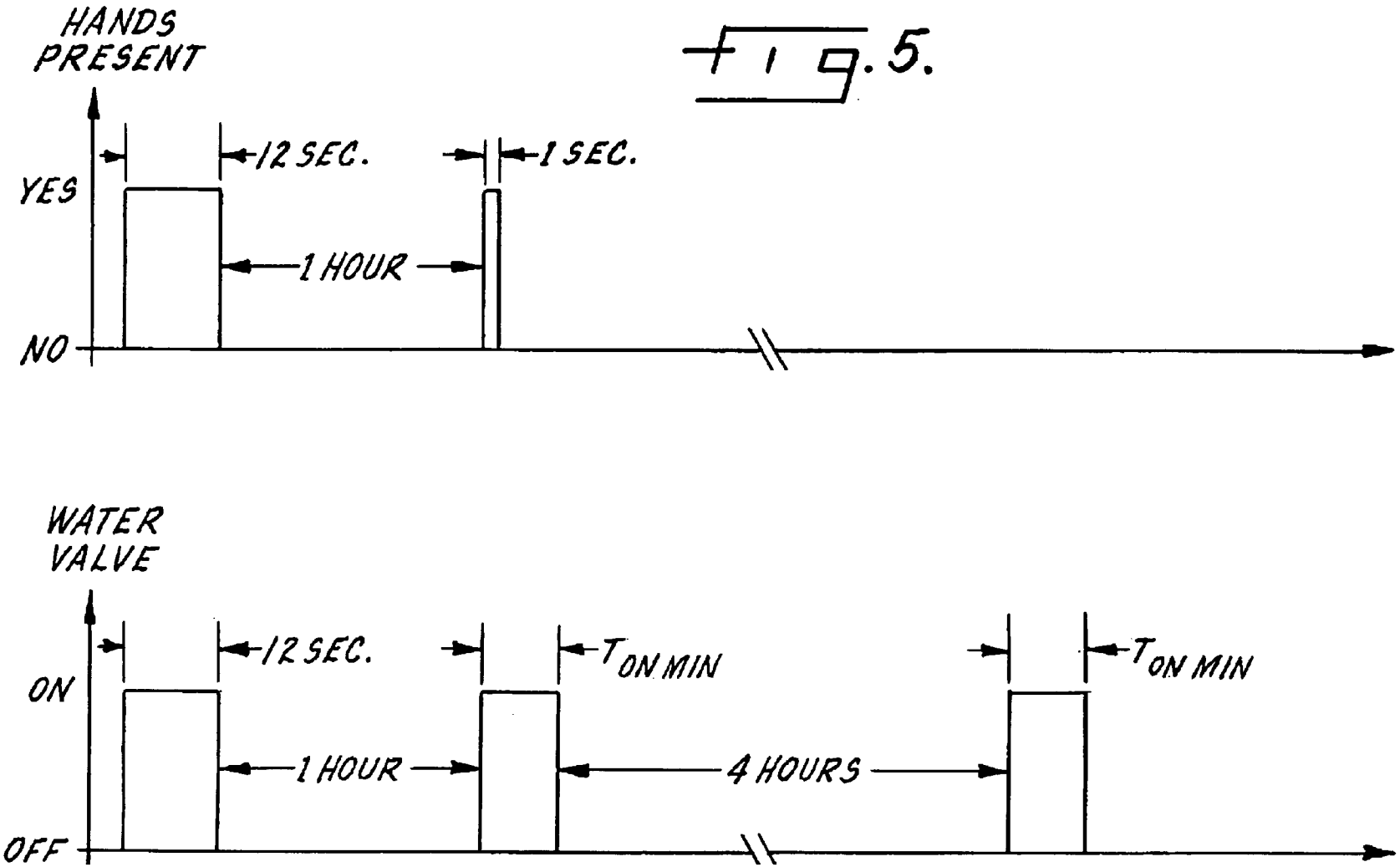
FIG. 5 is a timing diagram illustrating periodic activation of the electronic faucet of FIG. 1 to flush out and replace the water remaining in the faucet at timed intervals.

FIG. 5 is a timing diagram further illustrating one of the features of the present invention to periodically flush and replace the water remaining in electronic faucet 20, which may otherwise become stagnant or harbor accumulations of bacteria. FIG. 5 illustrates in timing diagrams the operation of the water valve 36, including both valves 36*a* and 36*b*, in response to the sensor assembly 24 detecting the presence of a user's hands. In the example of FIG. 5, it is assumed that the minimum run time TON MIN is 8 seconds and time-out is 60 seconds. In the beginning of the timing diagram example, a user's hands are detected for 12 seconds. Since 12 seconds exceeds the minimum run time of 8 seconds, the water valve will turn off at the end of the 12 seconds, plus any typically small delay in turning the water valve off after the sensor assembly determines that the user's hands are no longer present. In the example of FIG. 5, it is assumed that no such turn off delay exists.

One hour later in FIG. 5, the hands of a user are again detected, but only for one second. Since the water valve has been initiated, the system will continue to activate water flow through the valve for the minimum run time of 8 seconds or $T_{ON\ MIN}$. This ensures that the column of water is purged from the plumbing device. Thereafter, if there is no detection of a user's hands during a predetermined period, such as about 4 hours, the water valve will be activated for the minimum run time, $T_{ON\ MIN}$, which is assumed to be 8 seconds in this example.

While it cannot be guaranteed that this self-cleansing feature with a minimum run time will eliminate all bacteria in the water remaining in the faucet, it is expected to significantly reduce bacterial count in the faucet, and to keep the bacterial count lower than in corresponding faucets without this periodic activation feature and minimum run time.

It will be understood that the embodiments of the present invention that have been described are illustrative of some of the applications of the principles of the present invention. Various changes and modifications may be made by those skilled in the art without departing from the true spirit and scope of the invention.

What is claimed is:

1. An electronic plumbing device for controlling the flow of water through the electronic plumbing device, said device comprising:

a water valve operable between open and closed positions to control the flow of water through said device, said water valve normally in the closed position to block the flow of water;

said water valve including a solenoid to open the water valve and to permit the flow of water through said device when the solenoid is energized;

a relay to be selectively energized to supply electrical power to said solenoid;

a detector to detect the presence of a user near the device and to develop a detector signal indicative of the presence of a user;

a microprocessor, said microprocessor in communication with said detector and with said relay, said microprocessor causing the relay to be energized upon determining that said detector has developed said detector signal;

a first timer in said microprocessor for timing a first predetermined time interval representative of a minimum run time, said microprocessor terminating the energization of the relay to return the water valve to the closed position at end of the longer of when said detector signal ceases or said minimum run time; and a second timer in said microprocessor for timing a second predetermined time interval, said microprocessor causing the relay to be energized to supply electrical power to said solenoid and to open the water valve and permit water flow through said device at the end of the second predetermined time interval after energization of the relay was terminated for a minimum run time to flush any water remaining in the device from a prior activation of said device.

2. The electronic plumbing device as claimed in claim 1 wherein said second timer is reset each time that energization of the relay is terminated.

3. The electronic plumbing device as claimed in claim 1, wherein said first predetermined time interval associated with the minimum run time may be selected by programming of said microprocessor.

4. The electronic plumbing device as claimed in claim 3 wherein the first predetermined time interval is about 8 seconds.

5. The electronic plumbing device as claimed in claim 1 wherein said second predetermined time interval may be selected by programming of said microprocessor.

6. The electronic plumbing device as claimed in claim 5 wherein said second predetermined time interval is about 4 hours.

7. The electronic plumbing device as claimed in claim 1 wherein said electronic plumbing device includes two solenoids in the water valve.

8. An electronic circuit for controlling the flow of water through an electronic plumbing device, said device including a water valve operable between open and closed positions, said water valve normally in the closed position to block the flow of water through said device, said water valve including a solenoid to open the water valve to permit the flow of water through said device when the solenoid is energized, and a relay to supply electrical power to said solenoid, said electronic circuitry comprising:

a detector to detect the presence of a user near the device and to develop a detector signal indicative of the presence of a user;

a microprocessor, said microprocessor in communication with said detector and with said relay, said microprocessor causing the relay to be energized upon determining that said detector has developed said detector signal and to cause said relay to supply electrical power to said solenoid associated with the water valve;

a first timer in said microprocessor for timing a first predetermined time interval representative of a minimum run time, said microprocessor terminating the energization of the relay to return the water valve to the closed position at the longer of when said detector signal ceases or the minimum run time; and a second timer in said microprocessor for timing a second predetermined time interval, said microprocessor causing the relay to be energized to open the water valve and permit water flow through said device at the end of the second predetermined time interval for a minimum run time to flush any water remaining in the device from a prior activation of said device.

9. The electronic circuit as claimed in claim 8 wherein said second timer is reset each time that energization of the solenoid is terminated.

10. The electronic circuit as claimed in claim 8, wherein said first predetermined time interval associated with the minimum run time may be selected by programming of said microprocessor.

11. The electronic circuit as claimed in claim 10 wherein the first predetermined time interval is about 8 seconds.

12. The electronic circuit as claimed in claim 8 wherein said second predetermined time interval may be selected by programming of said microprocessor.

13. The electronic circuit as claimed in claim 12 wherein said second predetermined time interval is about 4 hours.

14. A method of controlling the flow of water through an electronic plumbing device wherein said device is of the type including a water valve operable between open and closed positions, the water valve normally in the closed position to block the flow of water through said device, the water valve including a solenoid to open the water valve to permit the flow of water through said device, and a relay to be selectively energized to supply electrical power to the solenoid, said method including the steps of:

developing a detector signal in response to the presence of a user near the device;

energizing said solenoid in response to the presence of the detect signal;

initiating a first timer to time a first predetermined time interval that is representative of a minimum run time;

terminating energization of said solenoid at the longer of when the detector signal ceases or at the end of the minimum run time;

initiating a second timer to time a second predetermined time interval at the end of the first predetermined time interval; and energizing said relay at the end of the second predetermined time interval for a minimum run time to flush any water remaining in the device from a prior activation of said device.

15. The method as claimed in claim 14, said method including the additional step of: resetting the second timer each time that energization of the relay is terminated.

16. The method as claimed in claim 14, said method including the additional step of:

setting the amount of time in said first predetermined time interval by programming said microprocessor.

17. The method as claimed in claim 16, wherein the amount of time in said first predetermined interval is set at about 8 seconds.

18. The method as claimed in claim 14, said method including the additional step of:

setting the amount of time in said second predetermined time interval by programming said microprocessor.

19. The method as claimed in claim 18, wherein the amount of time in said second predetermined time interval is set at about 4 hours.

* * * * *